United States Patent [19]

Sasano et al.

[11] 4,206,384

[45] Jun. 3, 1980

[54] IMAGE PICK-UP TUBE TARGET HAVING TRANSPARENT CONDUCTIVE STRIPS WITH SHALLOW SIDES

[75] Inventors: Akira Sasano, Kodaira; Toshio Nakano; Haruo Matsumaru, both of Tokyo; Ken Tsutsui, Hachioji; Tadaaki Hirai, Koganei; Eiich Maruyama, Kodaira, all of Japan

[73] Assignees: Hitachi Ltd.; Hitachi Denshi Kabushiki Kabusha, both of Japan

[21] Appl. No.: 882,041

[22] Filed: Feb. 28, 1978

[30] Foreign Application Priority Data

Mar. 2, 1977 [JP] Japan ..... 52-22458

[51] Int. Cl.[2] ..... H01J 29/45; H01J 31/46

[52] U.S. Cl. ..... 313/371; 313/386

[58] Field of Search ..... 313/371, 384, 386; 358/46

[56] References Cited

U.S. PATENT DOCUMENTS

| | | | |
|---|---|---|---|
| 2,908,835 | 10/1959 | Weimer | 313/371 |
| 3,087,985 | 4/1963 | Heijne et al. | 313/371 X |
| 3,772,552 | 11/1973 | Kubota | 313/371 |
| 3,984,721 | 10/1976 | Sato et al. | 313/371 |
| 3,997,810 | 12/1976 | Tsutsui et al. | 313/371 X |

*Primary Examiner*—Robert Segal

*Attorney, Agent, or Firm*—Craig and Antonelli

[57] ABSTRACT

For obtaining an improved characteristic, particularly an improved after-image characteristic of image pickup tubes, a target of the tube is produced by at first forming a striped transparent conductive film on a substrate such that the angle formed between the surface of the substrate and the edges of cross-section of the film falls within a range below 20°, and then forming a photoconductive film on the striped transparent conductive film. In order to control the angle formed between the surface of the substrate and the side edges of cross-section of the transparent conductive film, at first a mask of a predetermined pattern is formed on the transparent conductive film with a posi-type photosensitive material, and is subjected to an ultraviolet ray. The mask is then heat treated so that the side edges of the mask may be suitably tapered. Finally, the transparent conductive film is formed by sputter etching.

6 Claims, 18 Drawing Figures

IMAGE PICK-UP TUBE TARGET HAVING TRANSPARENT CONDUCTIVE STRIPS WITH SHALLOW SIDES

BACKGROUND OF THE INVENTION

1. Field of the Invention

The present invention relates to a target of an image pickup tube and a method of producing the same.

More particularly, the present invention relates to transparent conductive electrodes for use in, for example, image pickup tubes of a single tube or a double tube color camera, and to a method of controlling the cross-sectional shape of a transparent conductive film pattern suitable for producing the transparent conductive electrodes.

2. Description of the Prior Art

The signal electrode of an image pickup tube target for use in single or double tube type color cameras is composed of finely striped transparent conductive film. The structure of typical conventional image pickup tube targets having the striped transparent conductive film, as well as the method of producing the same, is as follows.

The color-sensitive target structure in the past is shown in FIG. 1. It is composed of two kinds of the glass substrates 1, 2 on which the tri-color striped filters 3 and the striped electrodes 4 are fixed respectively.

The filter stripes 3 are built in a repeated sequence of red, green, and blue transmission. The electrodes 4 consist of three sets of 216 stripes corresponding to the red, green, and blue filter stripes 3, and are connected by using the multilayered inner connection technique to the common output terminal for that color at both their tops and bottoms. In the drawings reference numeral 9 denotes bus-bars connected to the output terminal.

After polishing on the bottom side of the electrode substrate 7 on which the electrodes are fixed, the filter substrate 8 is cemented to it by means of a resin 5 as shown in FIG. 1. Then the photoconductive material 6 is deposited on the electrode side of the substrate. The target plate is thus completed.

The fundamental structure was concretely devised by Weimer and his co-workers about fifteen years ago.

This method is disclosed, for example, in S. Gray and P. K. Weimer, RCA Review, pp. 413–425, Sept. 1959;

P. K. Weimer, S. Gray et al, IRE Transactions on Electron Devices, pp. 147–153, July, 1960; and Harold Borkan, RCA Review, pp. 3–16, March, 1960.

Also, the present inventors have reported an article entitled "A Novel Tri-color Pick-up Tube For Use in A Single Tube Color TV Camera", in page 74 of "1974 Iedm Technical Digest".

The electrodes substrate 7 of this type is produced by the method detailed in the specification of U.S. Pat. Ser. No. 3,984,722.

As shown in FIG. 3A, a film 4 of $SnO_2$ is formed on a glass substrate 2 and a photoresist film is in turn formed on the $SnO_2$ film 4. The portions of the photoresist film corresponding to a predetermined pattern are exposed and developed in an ordinary manner and the non-exposed portion of the photoresist film is removed to form a mask 21. Thereafter, a sample 17 as shown in FIG. 3A is placed on the target electrode 11 of the RF sputtering apparatus 10 shown in FIG. 2. The internal air is evacuated through the evacuating port 14 so that the pressure inside the apparatus may be below $5\times10^{-6}$ Torr. Argon gas at a pressure of about $5\times10^{-3}$ Torr is led into the apparatus through the gas inlet port 13. An RF field is established between the target electrode 11 and the grounded electrode 12 by an RF power source 15 connected through a capacitor 16 between the electrodes 11 and 12. As a result, the argon gas is ionized to bombard the sample 17 so that the $SnO_2$ film 4 is etched through the mask 21 of the photoresist film due to sputtering phenomenon. The mask 21 is removed, after completion of etching, by rubbing it with the cotton swab in an ordinary photoresist stripper.

According to the method described above, as seen in the sample 18 shown in FIG. 3B, both the $SnO_2$ film 4 and the photoresist film 21 are etched due to the ion bombardment.

The $SnO_2$ film stripes 4 of the sample 19 in FIG. 3C, obtained as above, were uniform over the surface of the sample.

As a modification of the above described method, it is possible to use Cr, Ti or Mo film pattern. However, in all of these conventional structures, the angle $\theta$ formed between the surface of the substrate and the etched portion of the transparent conductive pattern is about 60°.

The target section of the image pickup tube is formed by coating the transparent electrode 4 with a photoconductive layer 6, by vacuum evaporation or the like method. FIG. 3D shows an example of this structure in cross-section. It will be seen from FIG. 3D that the portions of the photoconductive layer 6 on the transparent conductive film 4 and the portion of the same directly coating the substrate 2 have different heights from the surface of the substrate 2, i.e. the photoconductive layer is made to spread unevenly. Therefore, electric current is likely to be generated at the edge of this signal electrode, so as to cause an increment of dark current, during functioning of the tube. The increment of the dark current is serious especially in case of the structure incorporating a photoconductive film which exhibits a blocking-contact. Consequently, after a long time operation of the tube, undesirable roughening of the picture surface, as well as after image phenomenon, has been often experienced.

In another example of conventional technique to form a structure as shown in cross-section in FIG. 4, it is attempted to get rid of the disadvantage of the uneven spreading of the photoconductive layer as observed in the foregoing example. More specifically, the spaces between the adjacent islands of the striped transparent conductive film 4 are filled with insulating films 22 such as of glass, to form a smooth surface. However, this technique inconveniently necessitates troublesome steps of process subsequent to the formation of the striped transparent conductive film, such as coating with glass, and polishing and smoothening the glass.

SUMMARY OF THE INVENTION

It is therefore an object of the invention to overcome the above described problems of the prior art. More particularly, the invention aims at providing an image pickup tube target having an improved dark current characteristic and free from the after image phenomenon and, in addition, capable of being manufactured easily.

To this end, according to the invention, there is provided an image pickup tube target characterized at least in that a striped transparent conductive electrode is provided on a predetermined substrate, wherein the angle formed between the surface of the substrate and the side edge portion of the cross-section of the striped transparent conductive electrode is 20° or smaller, preferably 15° or smaller.

The image pickup target having the above specified striped transparent conductive electrode ensures improved after-image and dark current characteristics after the pickup of images.

In order to control the angle formed between the edge of the cross-section of the transparent conductive electrode and the surface of the substrate, there is also provided a method of producing the image pickup tube target characterized by comprising the steps of forming a predetermined mask pattern on the transparent conductive film with a posi-type organic photosensitive material, applying an ultra-violet ray, forming tapers at edges of the mask, and processing the transparent conductive film by a sputter etching.

DESCRIPTION OF THE PREFERRED EMBODIMENTS

Figure 1:
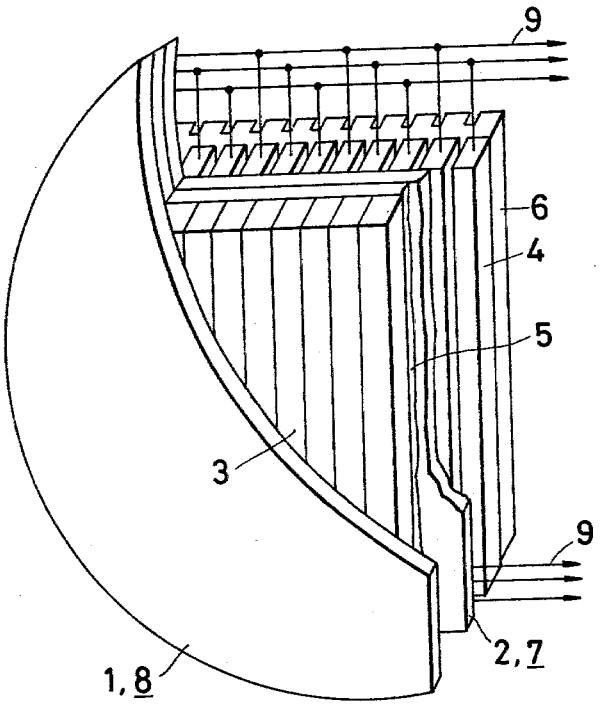
FIG. 1 PRIOR ART
FIG. 1 is a perspective view of a conventional image pickup tube target.

The image pickup tube target in accordance with the invention is characterized at least in that a plurality of striped transparent conductive electrodes is formed on a predetermined light-transmitting substrate, wherein the angle $\theta$ formed between the surface of the substrate and the side edges of the cross-section of each transparent conductive electrode is 20° or smaller.

As the material of the photoconductive film, $Sb_2S_3$, solid solution of Se-Te-As, PbO, CdS, CdSe, $As_2Se_3$ or the like are advantageously used. The Se-Te-As solid solution, PbO, CdS, CdSe, $As_2Se_3$ and the like are used generally in blocking contact with the transparent electrode.

The dark current characteristic and the after-image characteristic are largely improved regardless of the kind of the photoconductive film incorporated in the image pickup tube, by applying the present invention.

The improvement of the dark current characteristic of the image pickup tube is remarkable especially when the aforementioned angle $\theta$ is smaller than 15°, and more remarkable when a material exhibiting a blocking contact, e.g. Se-Te-As solid solution is used for the photoconductive film.

As stated before, the advantage of the invention can generally be achieved when the angle $\theta$ is 20° or smaller. However, from a practical point of view, it will be extremely difficult and almost impossible to work out the angle $\theta$ smaller than about 1°.

Needless to say, known materials such as $SnO_2$, $In_2O_3$ and so forth can fairly be used as the material of the transparent conductive film.

The features and advantages of the invention will become clear from the following description of the preferred embodiments.

The control of the cross-sectional shape of the transparent conductive electrode is performed substantially the following steps of process.

Namely, the method includes steps of forming a transparent conductive film on a predetermined substrate, forming a mask pattern on the transparent photoconductive film with a posi-type organic photosensitive material, heating the mask pattern to make the edges of the mask tapered, and processing the transparent conductive film by means of sputter etching in an inert gas atmosphere.

It has been well known to use an organic photosensitive material as the material of the mask for sputter etching. However, the method of the invention is based upon the following advantageous phenomena which have been discovered by the present inventors for the first time.

One of these advantageous phenomenon is that the formation of small taper at the edges of the masking material is considerably facilitated by applying ultraviolet rays to the masking pattern of the posi-type organic photosensitive material, after the formation of the same. More specifically, small tapers are formed at the edges of the masking pattern more easily than by conventional technique, that is by making use of a posi-type photosensitive material (usually, this type of material is a phenol-formaldehyde resin such as that sold under the trademark of Novolak resin), through an exposure and development to fix a desired pattern and then effecting a heat treatment subsequent to an application of ultraviolet rays.

The photoresist, which is usually made of an organic high molecular material, can be deformed to have a cross-sectional shape similar to that of convex lens. In posi-type photoresist, the deformation can be effected quite easily, because the high molecular material exhibits a photo-decomposition.

The result of the following test is enough to prove this fact.

Figure 5:
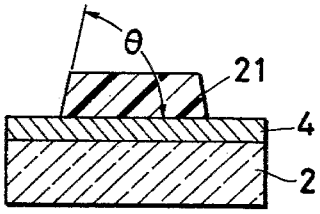
FIG. 5 is a cross-sectional view of a photoresist pattern.
Figure 6:
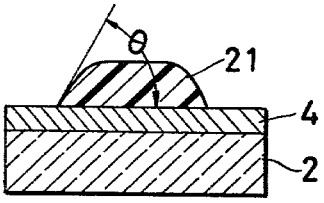
FIG. 6 is a cross-sectional view of the photoresist pattern having been subjected to a heat treatment.

At first, a transparent conductive film 4 was formed on a substrate 2, as shown in FIG. 5, on which was further applied photoresist 21 which may be a photoresist sold under a commercial name of AZ-1350J from Shipley Company. A cross-sectional shape of the photoresist as shown in FIG. 5 was obtained when an exposure and a development are effected in an ordinary manner. The angle $\theta$ was typically between 70° and 90°. The cross-sectional shape was changed as shown in FIG. 6 by further subjecting this sample to a heat treatment at 170° C. for about 30 minutes. The angle $\theta$ in this case was observed to be about 30°.

Figure 7:
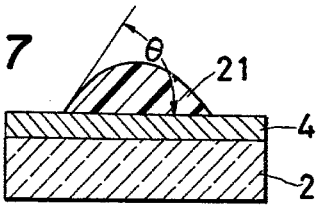
FIG. 7 is a cross-sectional view of the photoresist pattern having been subjected to a heat treatment subsequent to an application of ultraviolet ray, FIG. 8 experimentally shows a relationship between the sputter etching speeds of a transparent conductive film and a photoresist, and the partial pressure shared by oxygen contained in the inert gas atmosphere, as well as taper angles of the transparent conductive film after processing.

However, when the sample of FIG. 5 was heat treated in the same condition after an application of ultraviolet rays, a cross-sectional shape as shown in FIG. 7 was obtained, in which the angle $\theta$ was observed to be about 20°.

When an organic high molecular material is heat treated, the cross-sectional shape of the material is usually rounded. Thus, the angle $\theta$ of inclination as mentioned in the foregoing description is the inclination of the tangent to the high molecular material at a portion thereof in the vicinity of the point where the substrate and the material are merged in each other, as shown in the drawings.

As described above, the angle $\theta$ of inclination can be made smaller by adopting an additional step of application of ultraviolet rays. This allows selecting the ratio of the sputter etching speed of the masking material to that of the transparent conductive film to be not so large and, accordingly, a more stable processing.

Further, since the masking material has a larger height of top as shown in FIG. 7, it is fairly possible to allow the mask to remain when the processing is completed. Therefore, the transparent conductive film is less likely to be damaged when the processing is carried out with this mask.

The exposure to ultraviolet ray larger than that required in ordinary photoresist process is sufficient, but an exposure larger than that three times as large as that for the ordinary exposure is preferred. However, the exposure to ultraviolet rays need not be so large, because of the following reason.

The posi-type organic photosensitive material becomes more likely to be deformed due to the heat treatment, as well as to the ultraviolet ray application. However, this change of deformability becomes saturated when the ultraviolet ray application exceeds a predetermined rate. Thus, the level of exposure to ultraviolet rays is usually $2\times10^5$ lx.sec. to $4\times10^6$ lx.sec, although it depends on the photosensitive material.

A heat treating condition which would cause a deformation of the masking material will suffices. In most cases, the heat treatment is made at a temperature of between 150° C. and 250° C., and for a time between 5 minute and one hour.

The second advantage is that the sputter etching rate can be controlled suitably by making use of an inert gas containing oxygen as the atmosphere for the sputter etching.

In the method of the invention, it is essential and critical to form a mask pattern having a gentle taper on a transparent conductive film which in turn has been formed on a substrate.

When the etching is effected by sputter etching, the mask pattern itself is etched so that the edges of the transparent conductive film pattern are also tapered. The angle of taper of the edges of the transparent film pattern becomes smaller as the taper angle of the mask pattern gets smaller and as the sputter etching speed of the mask pattern gets larger as compared with that of the transparent conductive film.

It is therefore possible to control the cross-sectional shape of the transparent conductive film through controlling the cross-sectional shape of the mask pattern and the ratio of sputter etching speed of the mask material to that of the transparent conductive film.

Figure 8:
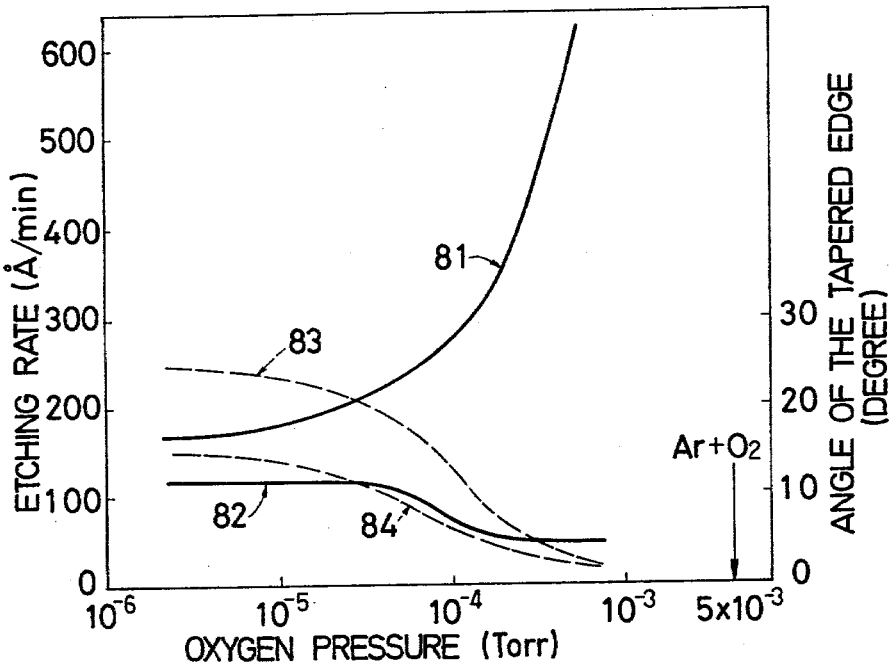

FIG. 8 shows the measured sputter etching speed of a photoresist and $SnO_2$ film under an atmosphere of Ar gas containing oxygen. The pressure of the atmosphere was $5\times10^{-3}$ Torr. The axis of abscissa shows the partial pressure of oxygen, while curves 81 and 82 show the sputter etching speeds of the photoresist and $SnO_2$ film, respectively. A high frequency wave power of 0.6 W/cm$^2$ was applied.

It will be seen from FIG. 8 that the sputter etching speed of $SnO^2$ film decreases, while the sputter etching speed of the photoresist film increases, as the partial pressure of $O_2$ becomes large. This characteristic can be obtained by usual sputtering conditions. For instance, the pressure of the atmospheric gas is between $10^{-3}$ and $10^{-2}$ Torr, while the input power is 0.02 to 0.07 w/cm$^2$. Thus, when a photoresist having a cross-sectional shape similar to that of a convex lens is used, the taper angle of edges of $SnO_2$ film becomes smaller as the partial pressure of oxygen comes larger. As will be seen from FIG. 8, the difference of sputter etching speed is remarkable especially within the range of oxygen density of between 1% and 10%. The oxygen density exceeding 10% causes a too large etching speed of the photoresist and, therefore, is not recommended. Practically, the oxygen density is preferably 3% or smaller. The etching speed of the photoresist is largely affected by a small change of oxygen density when the latter is excessively large, demanding a fine control of oxygen density as compared with the conventional processing.

Curves 83 and 84 in FIG. 8 show examples of sputter etching effected on an $SnO_2$ film of 3000 A° thick, covered by a mask of posi-type photoresist of 1.2 $\mu$m thick (product No. Az-1350J of Shipley Company). The axis of abscissa represents the partial pressure of oxygen in the sputtering atmosphere, while the axis of coordinate represents the taper angle of the $SnO_2$ film. The curve 83 shows the characteristic of an etching carried out after heat treating a striped mask at 170° C. for 30 minutes, while the curve 84 shows the characteristic of an etching performed with the same mask but subjecting the latter to an ultraviolet ray of 10,000 lx for 5 minutes before the heat treatment at 170° C. and 30 minutes. The input power and the pressure of sputtering atmosphere were 0.6 W/cm$^3$ and $5\times10^{-3}$ Torr, respectively.

It will be seen that it is quite effective to apply an ultraviolet ray to the photoresist, in advance to the heat treatment of the same, for realizing the smaller taper angle. At the same time, it is noted that a taper angle of smaller than 15° can be realized even when there is no oxygen content in the sputtering atmosphere.

EMBODIMENT 1

Figure 9A:
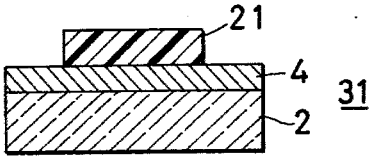
FIGS. 9A, 9B, 9C, 9D and 9E are cross-sectional views of an image pickup tube target of the invention, in respective steps of a process for manufacturing the same.

At first, an $SnO_2$ film 4 of 3000 A° thick was formed on a predetermined glass substrate glass substrate 2 by a known technique, as shown in FIG. 9A. Then, a posi-type photoresist (product No. Az-1350J) of Shipley Company) was applied on the $SnO_2$ film to form a coating layer of 1.2 $\mu$m. Subsequently, an exposure and development in the ordinary way were performed to form stripes of the photoresist of 14 $\mu$m breadth and 6 $\mu$m pitch. FIG. 9A shows a cross-section of a portion including one row of the stripe. Then, an ultraviolet ray was applied to the sample at a rate larger than ordinary photoresist conditions (10,000 lx) for 5 minutes. The sample was then subjected to a heat treatment of 170° C.

and 30 minutes. Consequently, the photoresist came to have a cross-section with a gentle taper of edges, as shown in FIG. 9B.

Figure 2:
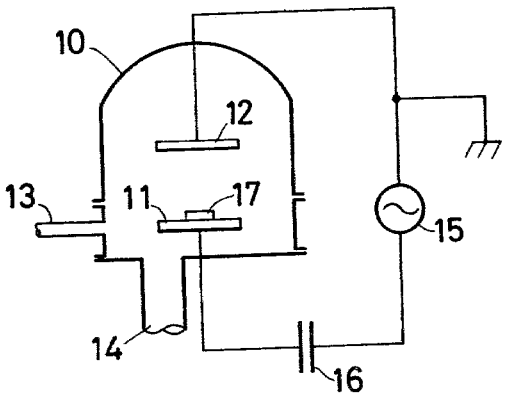
FIG. 2 is a longitudinal sectional veiw of etching apparatus used in carrying out the invention.
Figure 3A:
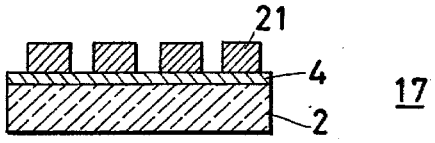
FIG. 3A PRIOR ART
FIGS. 3A, 3B, 3C and 3D are cross-sectional views of an image pickup tube target, showing the steps of conventional process for manufacturing the same.
Figure 3B:
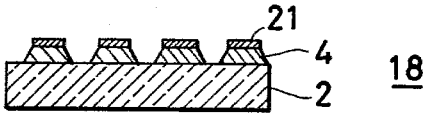
FIG. 3B PRIOR ART
Figure 3C:
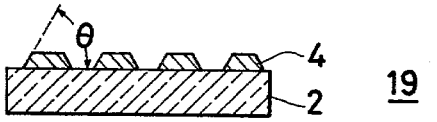
FIG. 3C PRIOR ART
Figure 3D:
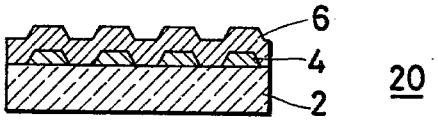
FIG. 3D PRIOR ART
Figure 4:
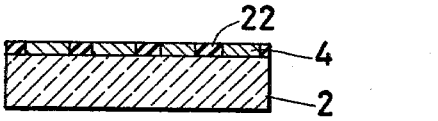
FIG. 4 PRIOR ART
FIG. 4 is a cross-sectional view of a conventional smoothened striped transparent conductive film.
Figure 9B:
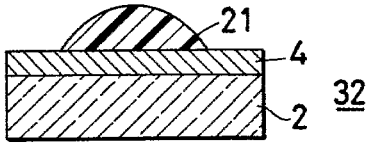

The sample 32 as shown in FIG. 9B was then placed on the target electrode 11 of an RF sputtering apparatus 10 as shown in FIG. 2.

The inernal air was evacuated through the evacuating port 14 so that the pressure inside the apparatus may be below $5\times10^{-6}$ Torr. Argon gas at the pressure of about $5\times10^{-3}$ Torr was led into the apparatus through the gas inlet port 13. Then, an RF field was established between the target electrodes 11 and 12.

Figure 9C:
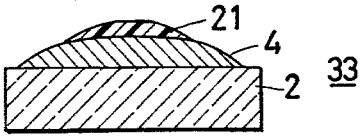

As a result, the argon was ionized to bombard the sample 32, so that the $SnO_2$ film 4 was etched through the mask 21 of the photoresist film due to sputtering phenomenon as shown in FIG. 9C.

Figure 9D:
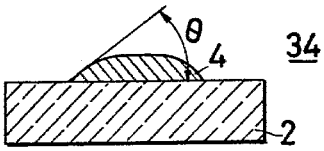

After a sputter etching with a high frequency power density of 0.6 W/cm$^2$ for 30 minutes, the photoresist was removed by means of a plasma etching device. The sample in this state is shown in FIG. 9D. The angle of taper of the $SnO_2$ stripe pattern was measured in this state to be 10°.

Then, the sample is processed in the same manner as the conventional technique.

The transparent electrodes are combined as required and connected to a common output terminal, by an ordinary multi-layer wiring technique.

More specifically, for instance, glass layers of about 2 μm are evaporated on the upper and lower faces of the transparent electrode by RF sputtering method. These insulating layers are perforated by ordinary photoresist technique, so as to provide a conductivity between the transparent electrode and the common electrode formed on the latter. Gold and chromium are used for the interconnecting conductor and the bonding layer, respectively.

Figure 9E:
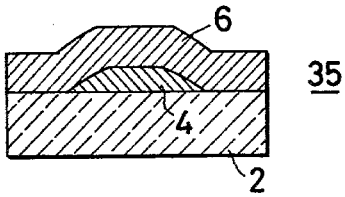

In case of a color image pickup tube, a filter subtrate, which has been mentioned in relation with prior art technique, is bonded by means of a resin. Then, Se-Te-As solid solution as the photoconductive film is vacuum-evaporated on the required portions of the sample 34, to have a thickness of 4 μm. FIG. 9E shows a portion of the produced electrode substrate 35.

Figure 10:
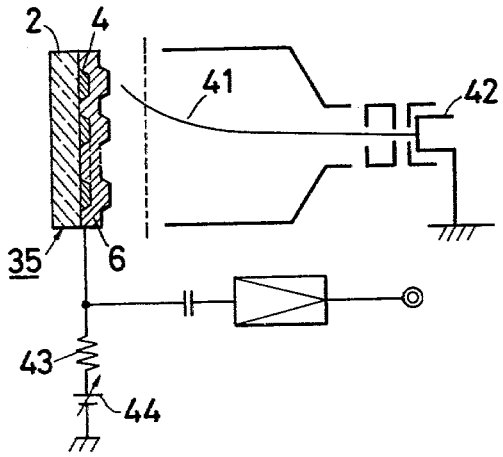
FIG. 10 is an illustration of the target as shown in FIGS. 9A to 9D incorporated in an image pickup tube.

An image pickup tube was produced by making use of an image pickup tube target obtained in the above described manner. FIG. 10 illustrates the incorporation of the target in the image pickup tube. In FIG. 10, numerals 35, 41, 42, 43 and 44 denote, respectively, the image pickup tube target, scanning electron beam, cathode, load resistance and a D.C. source.

The after-image and the dark current characteristics were evaluated employing the device as shown in FIG. 10. No substantial problem was caused by 20 minutes of image picking up, even when a photoconductive film exhibiting a blocking contact with the signal electrode, e.g. a solid solution of Se-Te-As was used, when the taper angle of $SnO_2$ film was 15°. As a result of a continuous image picking up of the same object for more than 1 hour, a dark current of 0.3 nA ws observed, but the characteristic was generally acceptable.

For the taper angle smaller than 15°, good characteristics were observed for both photoconductive films of Se-Te-As solid solution and $Sb_2S_3$ film.

The relationship observed between the taper angle $\theta$ and the after-image is shown in the following table 1. It will be seen that there is no problem when the taper angle is 15° or smaller, and even the taper angle of 20° is practically acceptable for a short time of use of the image pickup tube.

Figure 11:
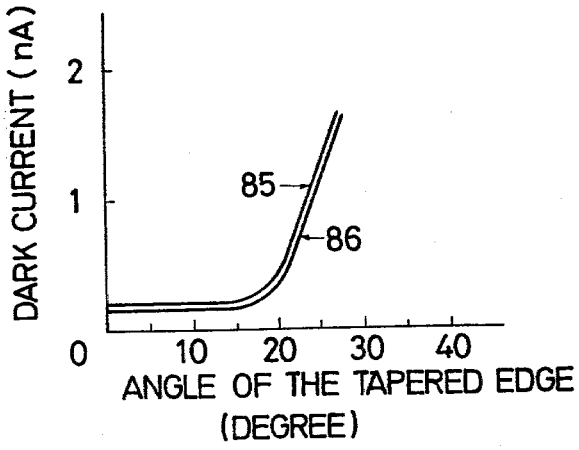
FIG. 11 shows an example of dark current characteristics.

At the same time, an especially superior dark current characteristic of the image pickup tube is provided especially by the taper angle $\theta$ smaller than 15°, when Se-Ts-As solid solution is used as the photoconductive film. The example of this characteristic is shown by curve 85 in FIG. 11, in which axes of abscissa and coordinate show, respectively, angle of taper and the dark current.

The advantage of the invention is expectable when the angle $\theta$ of taper is 20° or smaller. However, from a view point of the practical processing, it will be difficult to make the taper angle $\theta$ smaller than 1°.

Table 1

| Taper Angle ⊖ | after image after picking up of image 20 minutes | 60 minutes |
|---|---|---|
| 3° | no after image | no after image |
| 6° | " | " |
| 10° | " | " |
| 15° | " | " |
| 20° | " | after image observed |
| 25° | after image observed | after image observed |

A similar effect is obtained also when $In_2O_3$ is used as the material of the transparent conductive film.

EMBODIMENT 2

An $SnO_2$ film of 3000 A° thick was formed on a predetermined glass substrate. Then, stripe pattern of 14 μm breadth and 6 μm pitch were formed on the $SnO_2$ film, with a posi-type photoresist, in the same manner as the embodiment 1. Then, an ultraviolet ray was applied to the sample at a rate larger than the exposure rate (10000 lx) required in the ordinary photoresist process. Subsequently, the sample was heat treated at a temperature of 170° C. for 30 minutes. Then, a transparent conductive film was processed by means of a sputter etching, under a condition of atmosphere as shown the table 2. The table 2 shows also the taper angles $\theta$ of the resulting striped $SnO_2$ film, as well as the resulting image pickup characteristics. The pressure of the atmosphere and the density of the high frequency power were $5\times10^{-3}$ torr and 0.6 W/cm$^2$, respectively.

Table 2

| Sample No. | Oxigen Density % | Sputtering Time (min.) | Angle of Taper (°) | After Image after Picking up of Image 20 min. | 60 min. |
|---|---|---|---|---|---|
| 1 | 0.8 | 35 | 13 | no after image | no after image |
| 2 | 1.0 | 35 | 10 | " | " |
| 3 | 2.0 | 35 | 6 | " | " |
| 4 | 3.0 | 45 | 3 | " | " |

Then, an electrode substrate was formed by coating predetermined portions of the sample with a photoconductive film of Se-Te-As film of 4 μm, by means of vacuum evaporation.

The sample was then incorporated in the device as shown in FIG. 10, as is the case of the foregoing embodiment 1, for an evaluation of the after image and dark current characteristics after picking up of the image. The after image characteristic as and the dark current characteristic were found acceptable, as shown in table 2 and by a curve 86 in FIG. 11, respectively.

At the same time, it has been confirmed that good after image and dark current characteristics are obtainable with an electrode substrate having a photoconductive film of vacuum-evaporated $Sb_2S_3$ film of 1.5 μm thick.

Also, a similar effect has been obtained when $In_2O_3$ was used as the material of the transparent conductive film.

EMBODIMENT 3

An $SnO_2$ film of 3000 A° thick was formed on a predetermined substrate. Then, a stripe pattern of 14 m breadth and 6 m pitch was formed on the above film with a posi-type photoresist, in the same way as the foregoing embodiment 1. Then, the sample 31 as shown in FIG. 9A was heat treated at 200° C. for 30 minutes.

Subsequently, a sputter etching was performed in an Argon gas atmosphere containing 1% of oxigen for 35 minutes, with a high frequency power density of 0.6 W/cm$^2$. Consequently, an $SnO_2$ film stripe pattern having an edge taper angle $\theta$ of 15° was obtained. It was confirmed that the photoconductive type image pickup tube having a signal electrode constituted by this sample exhibit good characteristics, irrespective of whether the photoconductive film was made of $Sb_2S_3$ or Se-Te-As solid solution.

As an alternative, the sample 31 as shown in FIG. 9A was heat treated at 200° C. for 30 minutes, and then subjected to a sputter etching process which was performed for 45 minutes in an Argon gas atmosphere containing 3% of oxygen. The taper angle $\theta$ of the edges of transparent conductive film was observed to be 6°. It was also confirmed that the photoconductive type image pickup tube employing this sample exhibit good characteristics irrespective of whether the photoconductive film was made of $Sb_2S_3$ or Se-Te-As solution.

However, the satisfactory characteristics of the image pickup tube cannot be obtained when the taper angle of the edges of the transparent photoconductive film do not fall within the range as specified by the present invention.

The sample 31 as shown in FIG. 9A was heat treated at 200° C. for 30 minutes. The substrate thus prepared was then subjected to a sputter etching which was performed with a high frequency power density of 0.6 W/cm$^2$ for 30 minutes, within an atmosphere of Argon gas. Then, the photoresist was removed by a plasma ashing device. Consequently, a striped $SnO_2$ film was formed to have a taper angle $\theta_1$ of 25° at its edges. Then, Se-Te-As solid solution was applied to the striped film, as the photoconductive film, so as to form a target for an image pickup tube. This target was then incorporated in an image pickup tube, the characteristics of which were evaluated.

As a conclusion, this image pickup tube inconveniently exhibited a dark current of a level as high as 1.3 nA for a target voltage of 50 V, although this level is usually as low as 0.5 nA or lower when a material which shows a blocking contact with the signal electrode, e.g. Se-Te-As solid solution is used as the material of the photoconductive film. In addition, undesirable after image was observed, after a continuous image picking up of the same object for 20 minutes.

EMBODIMENT 4

An $SnO_2$ film of 3000 Å was formed on a predetermined substrate, on which further formed was a stripe pattern of a photoresist of 14 μm breadth and 6 μm pitch in the same manner as the foregoing embodiment 1. The resulting sample was then heat treated at 200° C. for 30 minutes, and further subjected to a sputter etching process which was carried out under an atmosphere of Argon gas containing 0.8% of oxigen for 35 minutes, with a high frequency power density of 0.6 W/cm$^2$. The angle $\theta_1$ of taper at the edges of the transparent conductive film was observed to be 20°.

The image pickup tube incorporating this sample as the signal electrode exhibited acceptable characteristics, without being accompanied by any substantial problem, when $Sb_2S_3$ was used as the material of the photo-conductive film. However, when Se-Te-As was used as the material of the photoconductive film, the image pickup tube showed an after image, after a continuous image picking up for longer than 1 hour, and a level of the dark current as high as 0.8 nA, although no substantial after image was observed after a continuous 20 minutes image picking up.

As has been described, according to the invention, it becomes possible to get the edges of the striped transparent conductive film in the form of a taper. This ensures good characteristics of the image pickup tube, even when a blocking-contact-type photoconductive film which causes a high electric field intensity around the signal electrode is used.

What is claimed is:

1. A target of an image pickup tube comprising a plurality of striped transparent conductive electrodes formed on a predetermined light-transmitting substrate, and a photoconductive film formed over said electrodes, characterized in that the angle formed between tapered side edges of said striped transparent conductive electrodes and the surface of said substrate is 20° or smaller.

2. A target of an image pickup tube as claimed in claim 1, wherein said angle formed between said tapered side edges of said striped electrodes and said surface of said substrate is 15° or smaller.

3. A target of an image pickup tube as claimed in claim 1, wherein said photoconductive film is made of a material which makes a blocking contact with said transparent conductive electrodes.

4. A target of an image pickup tube as claimed in claim 2, wherein said photoconductive film is made of a material which makes a blocking contact with said transparent conductive electrodes.

5. A target of an image pickup tube as claimed in claim 1, wherein said photoconductive film is made of a solid solution of Se-Te-As.

6. A target of an image pickup tube as claimed in claim 2, wherein said photoconductive film is made of a solid solution of Se-Te-As.

* * * * *